US008643460B2

(12) United States Patent
Tseng et al.

(10) Patent No.: US 8,643,460 B2
(45) Date of Patent: Feb. 4, 2014

(54) TRANSFORMER STRUCTURE

(75) Inventors: Hsiang-Yi Tseng, Taoyuan Hsien (TW); Hsin-Wei Tsai, Taoyuan Hsien (TW); Ching-Hsiang Tien, Taoyuan Hsien (TW); Han-Hsing Lin, Taoyuan-Hsien (TW); Yi-Lin Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/614,967

(22) Filed: Sep. 13, 2012

(65) Prior Publication Data

US 2013/0249659 A1 Sep. 26, 2013

(30) Foreign Application Priority Data

Mar. 26, 2012 (TW) ..... 101110448 A

(51) Int. Cl.

| | |
|---|---|
| ***H01F 27/30*** | (2006.01) |
| ***H01F 27/28*** | (2006.01) |
| ***H01F 27/29*** | (2006.01) |
| ***H01F 27/24*** | (2006.01) |

(52) U.S. Cl.

USPC ..... 336/198; 336/208; 336/192; 336/182; 336/212

(58) Field of Classification Search

USPC ..... 336/192, 198, 208, 170, 182, 212

See application file for complete search history.

(56) References Cited

U.S. PATENT DOCUMENTS

| | | | | |
|---|---|---|---|---|
| 4,419,814 | A * | 12/1983 | Hasserjian | 29/605 |
| 4,527,141 | A * | 7/1985 | Post | 336/192 |
| 7,446,637 | B1 * | 11/2008 | Liang et al. | 336/65 |
| 7,498,921 | B1 * | 3/2009 | Wang | 336/200 |
| 2010/0013590 | A1 * | 1/2010 | Chen et al. | 336/84 R |
| 2010/0026445 | A1 * | 2/2010 | Lin et al. | 336/84 R |
| 2011/0109418 | A1 * | 5/2011 | Lee et al. | 336/206 |
| 2011/0115595 | A1 * | 5/2011 | Tseng et al. | 336/192 |

* cited by examiner

*Primary Examiner* — Alexander Talpalatski
*Assistant Examiner* — Mangtin Lian
(74) *Attorney, Agent, or Firm* — Evan R. Witt; Kirton McConkie

(57) ABSTRACT

A transformer structure includes a bobbin, a conductive base, a first winding coil, plural second winding coils, and a magnetic core assembly. The bobbin includes a main body and a channel. The main body has a first winding section and plural first pins. The plural first pins are located at bilateral sides of the main body. The channel runs through the main body. The conductive base is disposed on a bottom side of the bobbin, and includes at least one connecting part. Through the connecting part of the conductive base, at least a portion of the plural first pins are electrically connected with each other. The first winding coil is wound around the first winding section. The second winding coils are connected with corresponding first pins. The magnetic core assembly is partially embedded into the channel of the bobbin.

9 Claims, 8 Drawing Sheets

TRANSFORMER STRUCTURE

TECHNICAL FIELD

The present disclosure relates to a transformer structure, and more particularly to a transformer structure with a conductive base.

DESCRIPTION OF THE RELATED ART

A transformer has become an essential magnetic element for voltage regulation into required voltages for various kinds of electric appliances.

Since the leakage inductance of the transformer has an influence on the electric conversion efficiency of a power converter, it is very important to control leakage inductance. In the power supply system of the new-generation electric products such as LCD televisions, leakage inductance transformers (e.g. LLC transformers) become more popular. Generally, the current generated from the power supply system will pass through a LC resonant circuit composed of an inductor L and a capacitor C, wherein the inductor L is inherent in the primary winding coil of the transformer. At the same time, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch, minimize noise and enhance performance. As the LCD panels become more and more large-sized and slim, many components (e.g. magnetic elements, conductive winding modules, or the like) are developed toward minimization and high electric conversion efficiency.

For applying the transformer to a slim electronic device, the transformer may be partially accommodated within a through-hole of a circuit board in order to reduce the overall height of the transformer and the circuit board.

However, the way of partially accommodating the transformer within the circuit board still has some drawbacks. For example, after the transformer is partially accommodated within a through-hole of a circuit board, the pins of the transformer are mounted on the circuit board at the locations near the through-hole. Generally, if the circuit board has no through-hole, the trace of the circuit board for connecting any two pins at bilateral sides of the transformer is directly under the transformer because the shortest distance between these two pins is achieved. However, if the circuit board has the through-hole, the trace for connecting any two pins at bilateral sides of the transformer fails to be installed at the location under the transformer because the through-hole is at this location. In other words, the trace should be buried in other location of the circuit board. Under this circumstance, the trace is relatively longer, and thus the material cost is increased. Moreover, since the through-out occupies much space of the circuit board and an additional space of the circuit board is required to install the trace, the space utilization of the circuit board is largely reduced.

Therefore, there is a need of providing an improved transformer structure in order to obviate the above drawbacks.

BRIEF SUMMARY

The present disclosure provides a transformer structure with a conductive base in order to reduce the length of the trace, increase the space utilization of the circuit board and save the material cost.

In accordance with an aspect of the present disclosure, there is provided a transformer structure. The transformer structure includes a bobbin, a conductive base, a first winding coil, plural second winding coils, and a magnetic core assembly. The bobbin includes a main body and a channel. The main body has a first winding section and plural first pins. The plural first pins are located at bilateral sides of the main body. The channel runs through the main body. The conductive base is disposed on a bottom side of the bobbin, and includes at least one connecting part. Through the connecting part of the conductive base, at least a portion of the plural first pins are electrically connected with each other. The first winding coil is wound around the first winding section. The second winding coils are connected with corresponding first pins. The magnetic core assembly is partially embedded into the channel of the bobbin.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
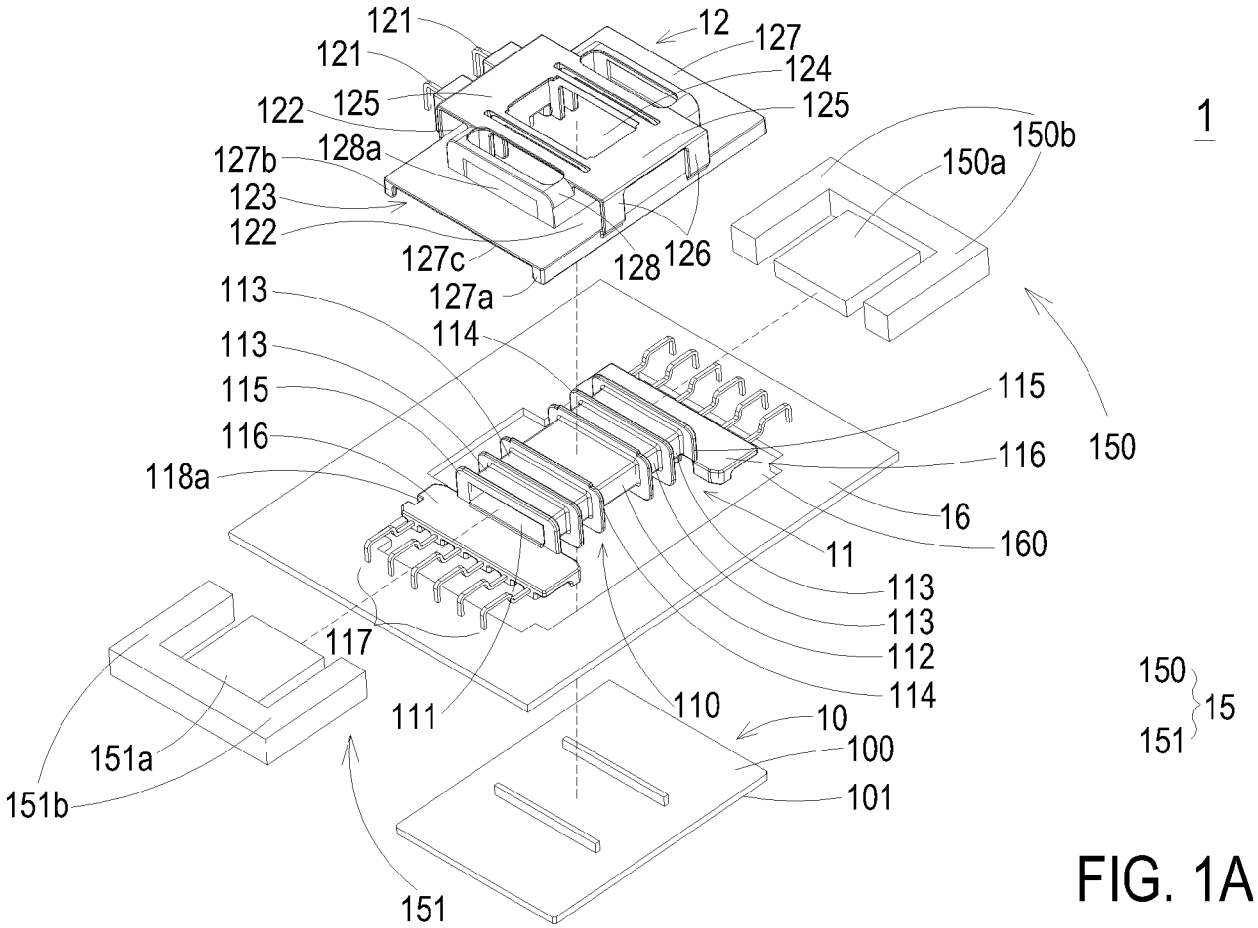
FIG. 1A is a schematic exploded view illustrating a transformer structure according to a first embodiment of the present disclosure, in which the winding coils are not shown.

FIG. 1A is a schematic exploded view illustrating a transformer structure according to a first embodiment of the present disclosure, in which the winding coils are not shown. The transformer structure 1 is mounted on a circuit board 16. The circuit board 16 has a through-hole 160. The size of the through-hole 160 matches the shape of the transformer structure 1. Since the transformer structure 1 is partially accommodated within the through-hole 160, the height of the transformer structure 1 relative to the circuit board 16 is reduced.

Please refer to FIG. 1A again. The transformer structure 1 comprises a conductive base 10, a bobbin 11, a covering member 12, a primary winding coil 13 (see FIG. 1C), plural secondary winding coils 14 (see FIG. 1C), and a magnetic core assembly 15. The bobbin 11 comprises a main body 110, a channel 111, plural partition plates 114, two lateral plates 115, and two connecting seats 116. The channel 111 runs through the main body 110. The two lateral plates 115 are located at bilateral sides of the main body 110. The plural partition plates 114 are disposed on the main body 110, located between the two lateral plates 115, and parallel with the two lateral plates 115. In this embodiment, the bobbin 11 comprises four partition plates 114. It is noted that the number of the partition plates 114 may be varied according to the practical requirements. A first winding section 112 and plural second winding sections 113 are defined by the partition plates 114, the two lateral plates 115 and the surface of the main body 110. In this embodiment, the bobbin 11 comprises one first winding section 112 and four second winding sections 113. It is noted that the number of the second winding sections 113 may be varied according to the practical requirements. The first winding section 112 is located at the middle portion of the main body 110. The four second winding sections 113 are equally located at the two lateral sides of the first winding section 112. The primary winding coil 13 is wound around the first winding section 112. The plural secondary winding coils 14 are wound around the second winding sections 113. The two connecting seats 116 are extended externally and vertically from the lateral plates 115, respectively. Several first pins 117 are extended externally from the connecting seats 116. The outlet terminals of the secondary winding coils 14 wound around and electrically connected with the corresponding first pins 117. In addition, the pins 117 are inserted into corresponding conductive holes (not shown) of the circuit board 16. After the pins 117 are welded on the circuit board, the transformer structure 1 is fixed on and electrically connected with the circuit board 16.

Please refer to FIG. 1A again. The covering member 12 is combined with the bobbin. The covering member 12 comprises a bottom plate 127, a receiving space 123, a receptacle plate 128, an opening 124, a stopper 125, an extension wall 126, and plural second pins 121. The bottom plate 127 comprises a first slab 127*a*, a second slab 127*b*, and a bottom surface 127*c*. The first slab 127*a* and the second slab 127*b* are extended downwardly from the two opposite edges of the bottom surface 127*c*. The receiving space 123 is defined by the first slab 127*a*, the second slab 127*b* and the bottom surface 127*c* of the bottom plate 127 for accommodating the bobbin 11. The receptacle plate 128 is extended upwardly from the bottom plate 127. Moreover, the receptacle plate 128 has a first receptacle 128*a* for partially accommodating the main body 110 of the bobbin 11 and the magnetic core assembly 15. The opening 124 is formed in the receptacle plate 128 and aligned with the first winding section 112 of the bobbin 11. Consequently, after the primary winding coil 13 is wound around the first winding section 112 and the covering member 12 is combined with the bobbin 11, the opening 124 provides an open space over the first winding section 112. Through the opening 124, the winding space of the first winding section 112 is increased. Moreover, since the opening 124 is aligned with the first winding section 112, the diameter and the turn number of the primary winding coil 13 may be increased. Under this circumstance, the electric conversion efficiency of the transformer is increased, and the heat-dissipating efficiency of the operating primary winding coil 13 is enhanced. The stopper 125 is located at bilateral sides of the opening 124. The extension wall 126 is vertically extended from the stopper 125 and connected with the bottom plate 127. In such way, two second receptacles 122 are defined by the stopper 125, the extension wall 126 and the bottom plate 127 for partially accommodating the magnetic core assembly 15. Consequently, after the magnetic core assembly 15 is partially accommodated within the second receptacle 122, the stopper 125 can increase the creepage distance between the primary winding coil 13 and the magnetic core assembly 15 for complying with the safety regulations. Moreover, plural second pins 121 are extended externally from a side of the extension wall 126. The outlet terminals of the primary winding coil 13 wound around and electrically connected with the corresponding second pins 121 (see FIG. 2A).

Figure 1B:
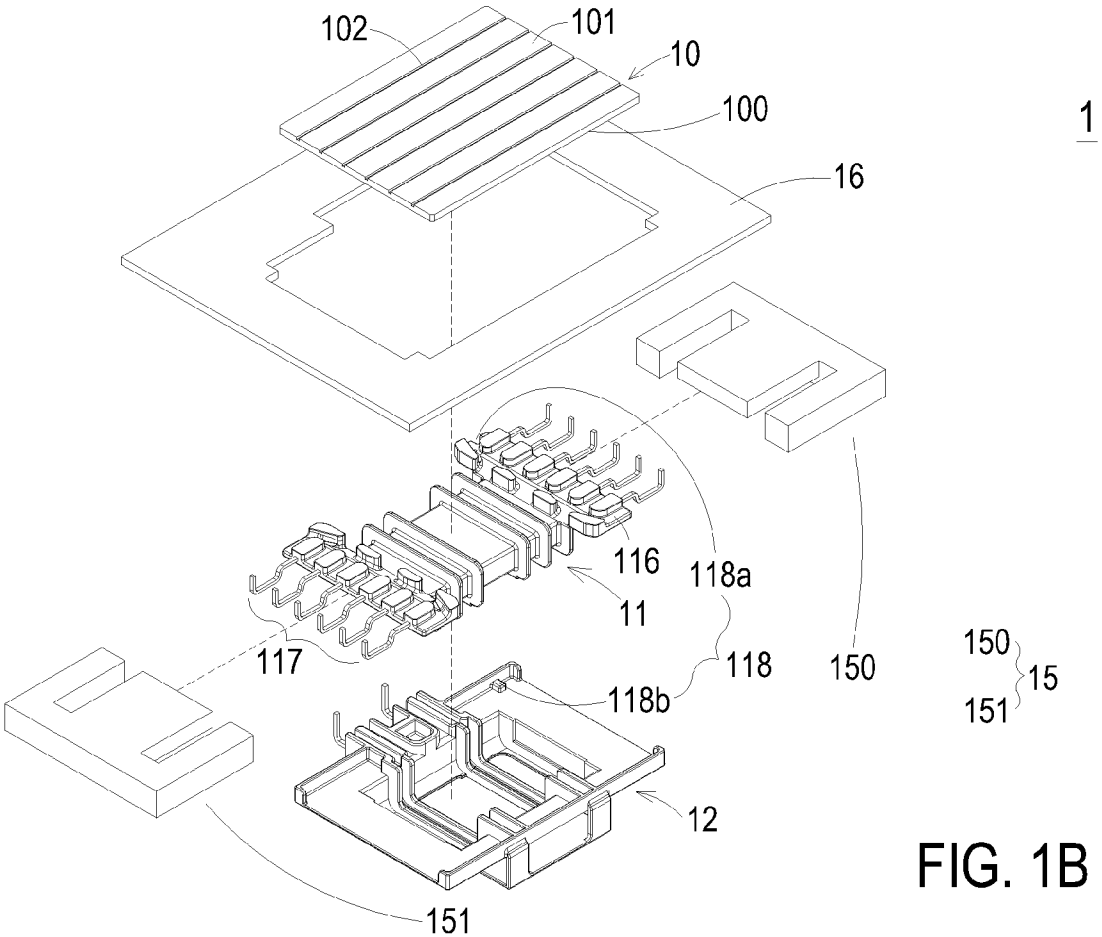
FIG. 1B is a schematic exploded view illustrating the transformer structure of FIG. 1A and taken along another viewpoint.

FIG. 1B is a schematic exploded view illustrating the transformer structure of FIG. 1A and taken along another viewpoint. The conductive base 10 comprises a first surface 100, a second surface 101, and at least one connecting part 103 (see FIG. 2B). The first surface 100 and the second surface 101 are opposed to each other. Through the connecting part 103 of the conductive base 10, the first pins 117 at the bilateral sides of the bobbin 11 can be electrically connected with each other. At the same time, the creepage distance is increased to comply with the safety regulations.

Figure 2A:
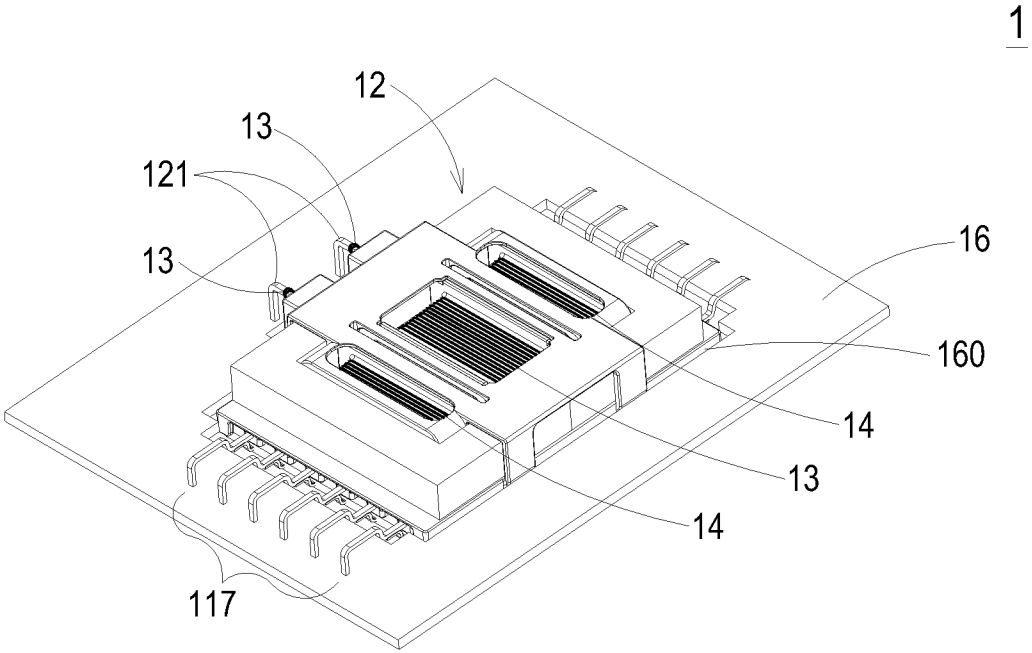
FIG. 2A is a schematic assembled view illustrating the transformer structure of FIG. 1C.
Figure 2B:
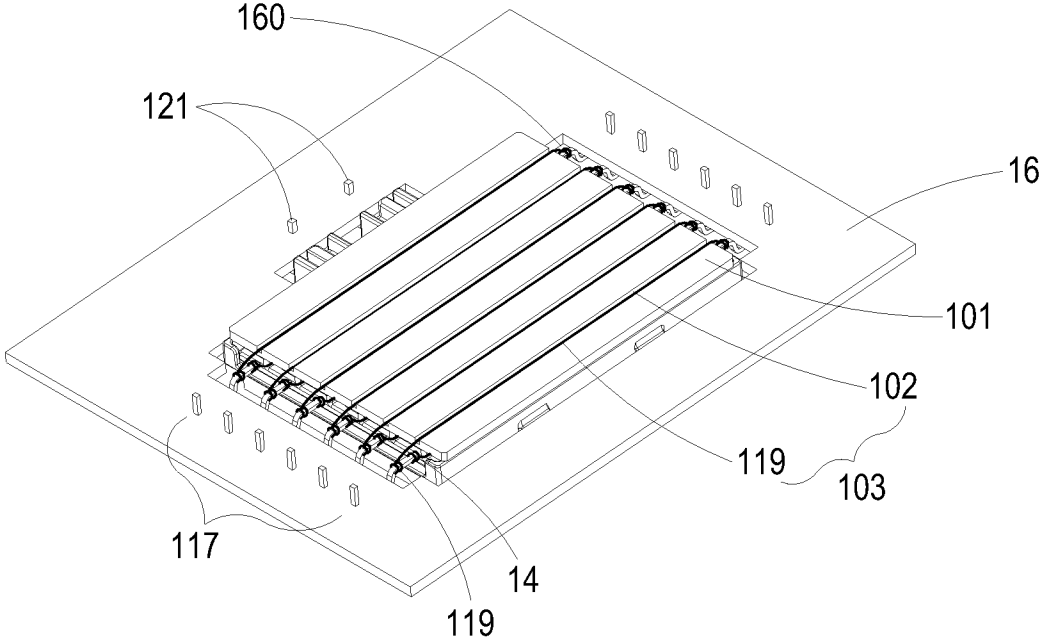
FIG. 2B is a schematic assembled view illustrating the transformer structure of FIG. 2A and taken along another viewpoint.

Please refer to FIG. 1B as well as FIG. 2B. In this embodiment, the connecting part 103 comprises plural recesses 102 and plural conductor lines 119. The plural recesses 102 are formed in the second surface 101 and aligned with corresponding first pins 117 at the bilateral sides of the bobbin 11. The plural conductor lines 119 are accommodated within respective recesses 102. The both ends of each conductor line 119 are connected with the corresponding first pins 117 at the bilateral sides of the bobbin 11, so that the corresponding first pins 117 at the bilateral sides of the bobbin 11 are electrically connected with each other. Consequently, the creepage distance is increased to comply with the safety regulations. Under this circumstance, it is not necessary to install long traces on the circuit board 16 to connect the corresponding first pins 117 at the bilateral sides of the bobbin 11. Consequently, the wiring space of the circuit board 16 is decreased, and the material cost is reduced.

In this embodiment, the plural recesses 102 are formed on the second surface 101 of the conductive base 10 and parallel with each other. Alternatively, according to the way of connecting the corresponding first pins 117 at the bilateral sides of the bobbin 11, the plural recesses 102 may not be parallel with each other. In some embodiment, the transformer structure 1 further comprises a positioning member between the bobbin 11 and the covering member 12 for facilitating positioning the bobbin 11 and the covering member 12. As shown in FIGS. 1B and 1A. The transformer structure 1 has a positioning member 118. The positioning member 118 comprises a first positioning part 118*a* and a second positioning part 118*b*. The first positioning part 118*a* is disposed on one connecting seat 116 of the bobbin 11 (see FIG. 1A). Corresponding to the first positioning part 118*a*, the second positioning part 118*b* is disposed on the bottom plate 127 of the covering member 12 and accommodated within the receiving space 123 (see FIG. 1B). After the first positioning part 118*a* and the second positioning part 118*b* are engaged with each other, the bobbin 11 and the covering member 12 are combined together. In other words, due to the positioning member 18, the worker may easily and precisely combine the bobbin 11 and the covering member 12 together for saving the assembling time.

Please refer to FIG. 1A again. The magnetic core assembly 15 comprises a first magnetic part 150 and a second magnetic part 151. The first magnetic part 150 comprises a middle portion 150*a* and two leg portions 150*b*. The second magnetic part 151 also comprises a middle portion 151*a* and two leg portions 151*b*. For assembling the transformer structure 1, the middle portions 150*a* and 151*a* are embedded into the first receptacle 128*a* of the covering member 12 and the channel 111 of the bobbin 11, and the leg portions 150*b* and 151*b* are embedded into the second receptacles 122 at bilateral sides of the covering member 12. Consequently, the first magnetic part 150, the second magnetic part 151, the conductive base 10, the bobbin 11 and the covering member 12 are combined together to assemble the transformer structure 1. In this embodiment, the first magnetic part 150 and the second magnetic part 151 are E cores, so that the magnetic core assembly 15 is an EE-type magnetic core assembly. Alternatively, the first magnetic part 150 and the second magnetic part 151 of the magnetic core assembly 15 may be a UI-type magnetic core assembly or an EI-type magnetic core assembly in other embodiments.

Figure 1C:
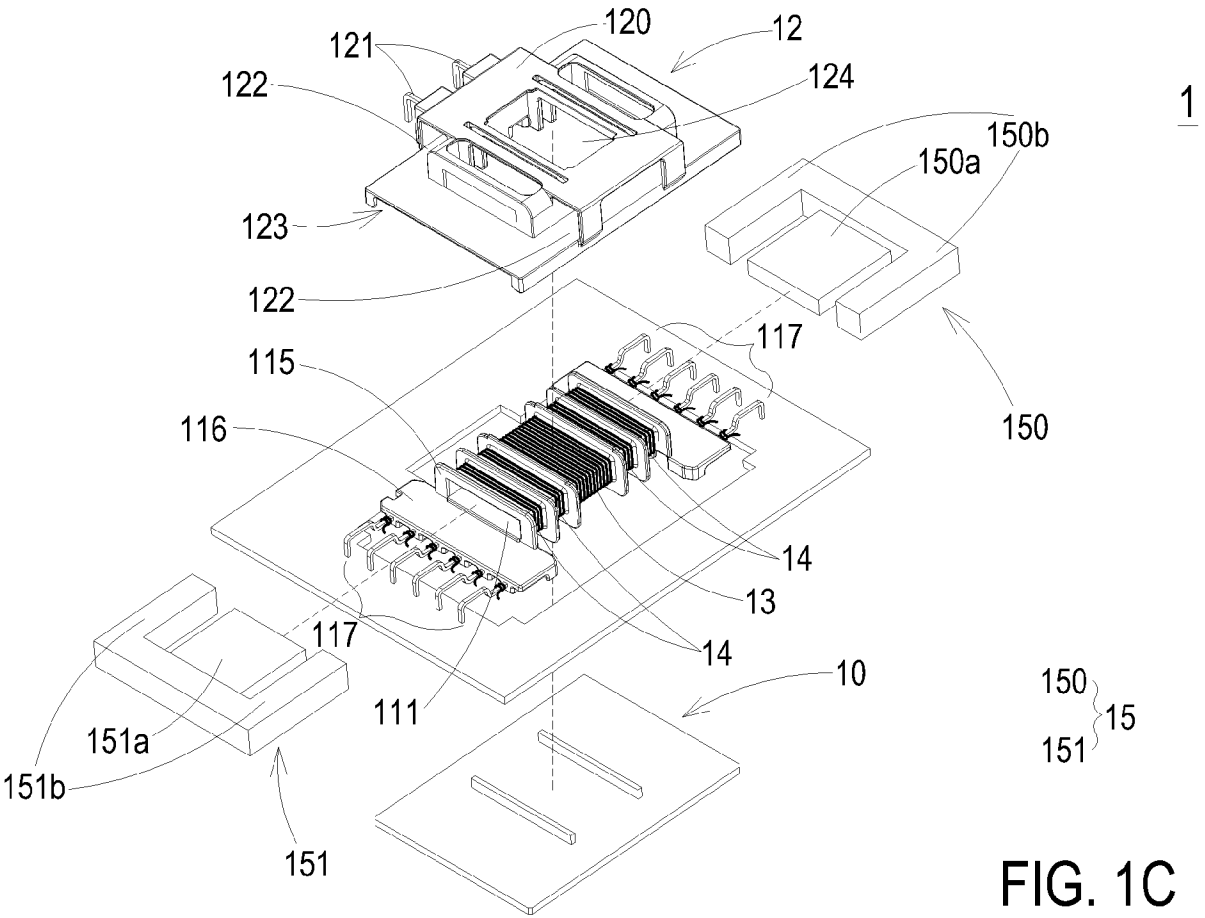
FIG. 1C is a schematic exploded view illustrating a transformer structure according to the first embodiment of the present disclosure, in which the winding coils are wound around the bobbin.

FIG. 1C is a schematic exploded view illustrating a transformer structure according to the first embodiment of the present disclosure, in which the winding coils are wound around the bobbin. The primary winding coil 13 is a conductive wire, which is wound around the first winding section 112 of the main body 110 of the bobbin 11. The second winding coils 14 are also conductive wires, which are respectively wound around the second winding sections 113. After the covering member 12 and the bobbin 11 are combined together, the two outlet terminals (not shown) of the primary winding coil 13 are respectively wound around and fixed on the second pins 121 of the covering member 12. The two outlet terminals of each second winding coil 14 are respectively wound around and fixed on corresponding first pins 117 of the bobbin 11. Since the two outlet terminals of the primary winding coil 13 are wound around and fixed on the second pins 121 of the covering member 12, the winding space of the first winding section 112 and the turn number of the primary winding coil 13 may be increased. Under this circumstance, the electric conversion efficiency of the transformer structure 1 is increased, and the heat-dissipating efficiency of the transformer structure 1 is enhanced.

FIG. 2A is a schematic assembled view illustrating the transformer structure of FIG. 1C. FIG. 2B is a schematic assembled view illustrating the transformer structure of FIG. 2A and taken along another viewpoint. Hereinafter, a process of assembling the transformer structure 1 will be illustrated with reference to FIGS. 2A and 2B. Firstly, the primary winding coil 13 is wound around the first winding section 112 of the main body 110 of the bobbin 11, and the plural second winding coils 14 are wound around respective second winding sections 113. Then, the covering member 12 is combined with the bobbin 11 through the positioning member 118. Consequently, the bobbin 11, the primary winding coil 13 and the plural second winding coils 14 are partially accommodated within the receiving space 123 of the covering member 12. Then, the first surface 100 of the conductive base 10 is fixed on the bottom side of the bobbin 11 by a dispensing means or a soldering means. After the conductive base 10 and the bobbin 11 are combined together, the two outlet terminals of the primary winding coil 13 are wound around and fixed on the second pins 121 of the covering member 12, and the outlet terminals of the second winding coils 14 are wound around and fixed on respective first pins 117 of the bobbin 11. Then, the both ends of each conductor line 119 within the corresponding recess 102 are wound around and fixed on the corresponding first pins 117 at the bilateral sides of the bobbin 11. Consequently, the corresponding first pins 117 at the bilateral sides of the bobbin 11 are electrically connected with each other. Then, the middle portions 150*a* and 151*a* of the first magnetic part 150 and the second magnetic part 151 are embedded into the channel 111 of the bobbin 11. In addition, the leg portions 150*b* and 151*b* are embedded into the second receptacles 122 and located around the bobbin 11. Meanwhile, the transformer structure 1 is assembled. Afterwards, the transformer structure 1 is accommodated within the through-hole 160 of the circuit board 16, and the plural first pins 117 of the bobbin 11 are inserted into corresponding conductive holes of the circuit board 16, so that the transformer structure 1 is electrically connected with the circuit board 16.

The above assembling process is presented herein for purpose of illustration and description only. According to the practical requirements, the assembling process may be varied. For example, in some other embodiments, after the bobbin 11, the covering member 12 and the magnetic core assembly 15 are combined together and mounted on the circuit board 16, the conductive 10 is combined with the bobbin 11.

Figure 3A:
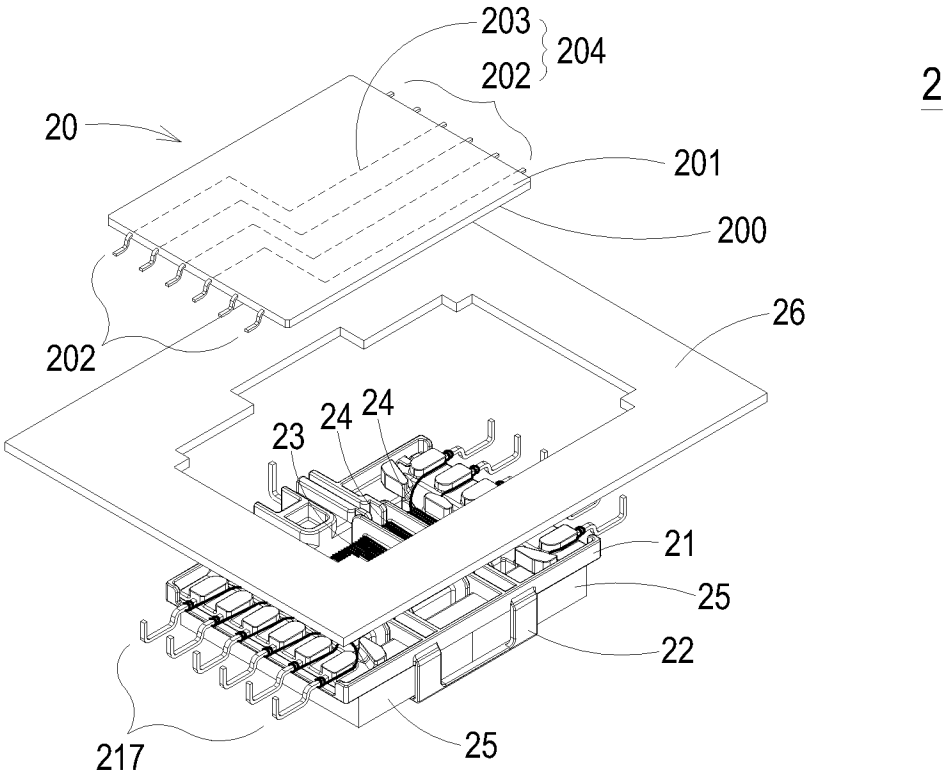
FIG. 3A is a schematic partially exploded view illustrating a transformer structure according to a second embodiment of the present disclosure.
Figure 3B:
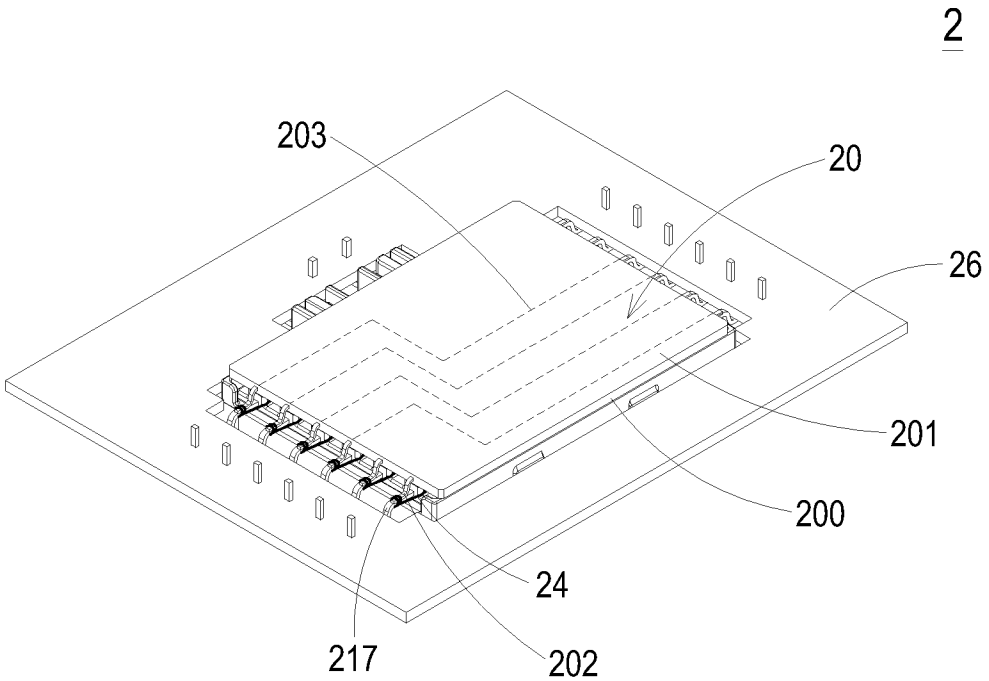
FIG. 3B is a schematic assembled view illustrating the transformer structure of FIG. 3A.

FIG. 3A is a schematic partially exploded view illustrating a transformer structure according to a second embodiment of the present disclosure. FIG. 3B is a schematic assembled view illustrating the transformer structure of FIG. 3A. As shown in FIG. 3A, the transformer structure 2 comprises a conductive base 20, a bobbin 21, a covering member 22, a primary winding coil 23, plural secondary winding coils 24, and a magnetic core assembly 25. The transformer structure 2 is mounted on a circuit board 26. The configurations of the bobbin 21, the covering member 22, the primary winding coil 23, the secondary winding coils 24, the magnetic core assembly 25 and the circuit board 26 are similar to those of the first embodiment, and are not redundantly described herein. In comparison with the conductive base 10 of the first embodiment, the conductive base 20 of this embodiment comprises plural third pins 202 and plural traces 203. The plural third pins 202 are located at bilateral sides of the conductive base 20 and aligned with respective first pins 217 of the bobbin 21. In addition, the plural third pins 202 are connected with respective first pins 217 of the bobbin 21. The traces 203 are buried within the conductive base 20. Through the traces 203, the plural third pins 202 are selectively connected with each other according to the practical requirement. Consequently, after the secondary winding coils 24 are wound around the bobbin 21 and the outlet terminals thereof are wound around and fixed on respective first pins 217, the third pins 202 of the conductive base 20 are connected with respective first pins 217 of the bobbin 21 and the first surface 200 of the conductive base 20 is fixed on the bottom side of the bobbin 21. Consequently, the third pins 202 of the conductive base 20 are electrically connected with respective first pins 217 of the bobbin 21 (see FIG. 3B). Through the third pins 202 and the traces 203, the first pins 217 of the bobbin 21 are electrically connected with each other. The arrangement of the traces is presented herein for purpose of illustration and description only. While the practical requirements of the connecting ways of the first pins 217 are different in other embodiments, it is easy to replace the conductive base 20 with other conductive bases which have different trace arrangement. Since it is not necessary to replace the whole circuit board 26, the material cost is reduced.

Figure 4:
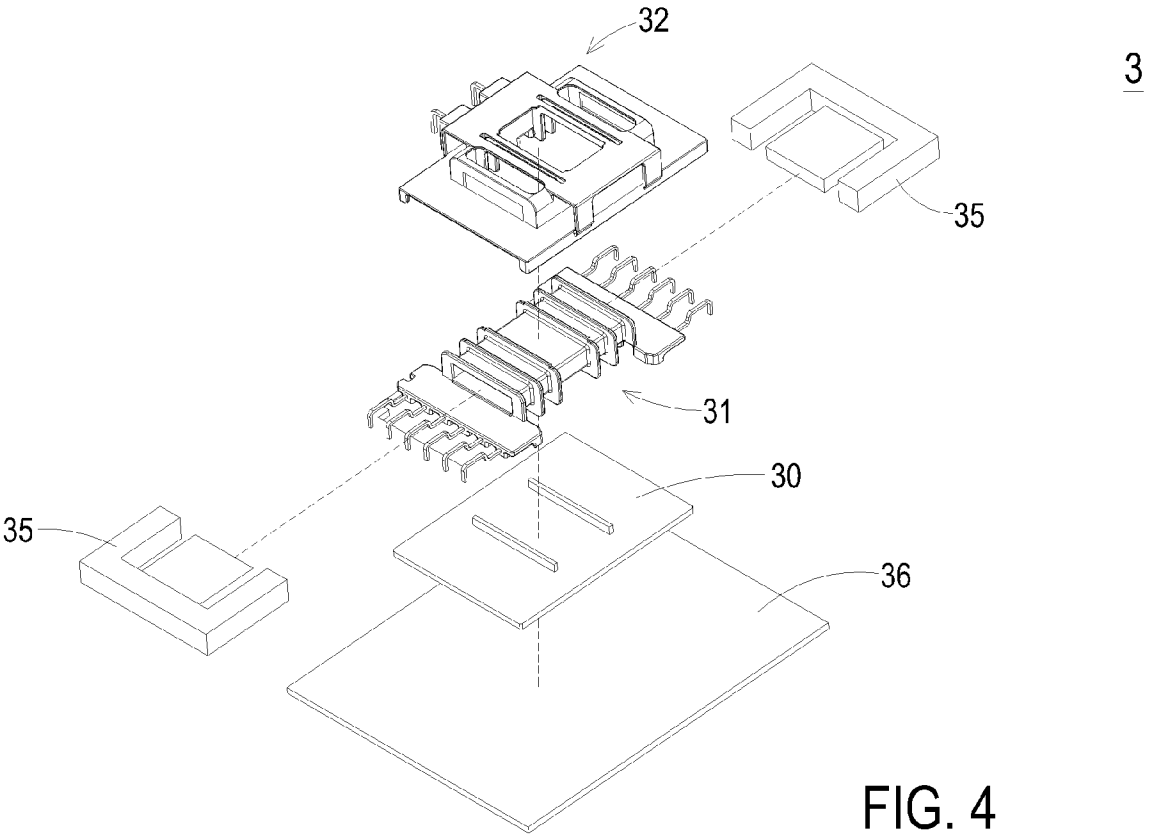
FIG. 4 is a schematic exploded view illustrating a transformer structure according to a third embodiment of the present disclosure, in which the winding coils are not shown.

FIG. 4 is a schematic exploded view illustrating a transformer structure according to a third embodiment of the present disclosure, in which the winding coils are not shown. As shown in FIG. 4, the transformer structure 3 comprises a conductive base 30, a bobbin 31, a covering member 32, a primary winding coil (not shown), plural secondary winding coils (not shown), and a magnetic core assembly 35. The transformer structure 3 is mounted on a circuit board 36. The configurations of the bobbin 31, the covering member 32, the primary winding coil 33, the secondary winding coils 34 and the magnetic core assembly 35 are similar to those of the first embodiment, and are not redundantly described herein. In this embodiment, the circuit board 36 has no through-hole. Consequently, the conductive base 30 is arranged between the bobbin 31 and the circuit board 36. Through the connecting part of the conductive base 30, the first pins at the bilateral sides of the bobbin 31 can be electrically connected with each other. Under this circumstance, the creepage distance is increased to comply with the safety regulations.

From the above description, the present disclosure provides a transformer structure. Through the connecting part of the conductive base, the first pins at the bilateral sides of the bobbin can be electrically connected with each other. Under this circumstance, it is not necessary to install long traces on the circuit board to connect the corresponding first pins at the bilateral sides of the bobbin. Consequently, the wiring space of the circuit board is decreased, and the material cost is reduced. Moreover, the conductive base may be replaced according to the practical requirements of changing the connecting ways of the first pins. That is, the original conductive base may be replaced with another conductive base with desired recesses or traces. Under this circumstance, the applications of the present disclosure can be expanded. Moreover, since it is not necessary to replace the whole circuit board, the material cost is reduced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer structure, comprising:

a bobbin comprising a main body and a channel, wherein said main body has a first winding section and plural first pins, said plural first pins are located at bilateral sides of said main body, and said channel runs through said main body;

a conductive base disposed on a bottom side of said bobbin, and comprising at least one connecting part, wherein through said connecting part of said conductive base, at least a portion of said plural first pins are electrically connected with each other;

a first winding coil wound around said first winding section;

plural second winding coils connected with corresponding first pins;

a magnetic core assembly partially embedded into said channel of said bobbin; and said connecting part of said conductive base comprises plural third pins and at least one trace, wherein said trace is buried within said conductive base and connected with two of said plural third pins, wherein said two of said plural third pins are extended from bilateral sides of said conductive base and electrically connected with two of said plural first pins at said bilateral sides of said main body of said bobbin, so that said two of said plural first pins at said bilateral sides of said main body of said bobbin are electrically connected with each other through said trace.

2. The transformer structure according to claim 1, wherein said transformer structure is mounted on said circuit board, wherein said circuit board has a through-hole for partially accommodating said transformer structure, and said plural first pins are inserted into said circuit board.

3. The transformer structure according to claim 1, further comprising a covering member, which is combined with said bobbin, wherein said covering member comprises:

a bottom plate comprises a slab and a bottom surface, wherein said slab is extended downwardly from an edge of said bottom surface;

a receiving space defined by said slab and said bottom surface of said bottom plate for partially accommodating said bobbin;

a receptacle plate extended upwardly from said bottom plate, wherein said receptacle plate has a first receptacle for partially accommodating said main body of said bobbin and said magnetic core assembly, and said receptacle plate has an opening aligned with said first winding section of said bobbin;

a stopper located at bilateral sides of said opening and parallel with said bottom plate;

an extension wall vertically extended from said stopper and connected with the bottom plate, wherein at least one second receptacle is defined by said stopper, said extension wall and said bottom plate for partially accommodating said magnetic core assembly; and plural second pins extended externally from a side of said extension wall, wherein two outlet terminals of said first winding coil are wound around and connected with corresponding said second pins.

4. The transformer structure according to claim 3, wherein said bobbin further comprises two lateral plates and two connecting seats, wherein said two lateral plates are located at bilateral sides of said main body, said two connecting seats are extended externally from said two lateral plates, and said plural first pins are extended from said connecting seats.

5. The transformer structure according to claim 4, further comprising a positioning member, wherein said positioning member comprises a first positioning part and a second positioning part, wherein said first positioning part is disposed on one of said two connecting seats of said bobbin, and said second positioning part is disposed on an inner surface of said covering member corresponding to said first positioning part, wherein after said first positioning part and said second positioning part are engaged with each other, said bobbin and said covering member are combined together.

6. The transformer structure according to claim 3, wherein said main body of said bobbin further comprises plural second winding sections, wherein said plural second winding coils are wound around corresponding said second winding sections.

7. The transformer structure according to claim 6, wherein said bobbin further comprises plural partition plates, two lateral plates, and two connecting seats, wherein said plural partition plates are disposed on said main body, said two lateral plates are located at bilateral sides of said main body, said two connecting seats are extended externally from said two lateral plates, and said plural first pins are extended from said connecting seats, wherein said first winding section and said plural second winding sections are defined by said plural partition plates and said lateral plates.

8. The transformer structure according to claim 7, further comprising a positioning member, wherein said positioning member comprises a first positioning part and a second positioning part, wherein said first positioning part is disposed on one of said two connecting seats of said bobbin, and said second positioning part is disposed on an inner surface of said covering member corresponding to said first positioning part, wherein after said first positioning part and said second positioning part are engaged with each other, said bobbin and said covering member are combined together.

9. The transformer structure according to claim 1, wherein said conductive base further comprises a first surface and a second surface, wherein said first surface and said second surface are opposed to each other, and said first surface of said conductive base is attached on said bottom side of said bobbin.

* * * * *